US011384614B2

(12) United States Patent
Tuttle et al.

(10) Patent No.: US 11,384,614 B2
(45) Date of Patent: Jul. 12, 2022

(54) PRESSURE BALANCED RUNNING TOOL

(71) Applicants: Elliott Tuttle, Anchorage, AK (US); James Fraser, Spring, TX (US)

(72) Inventors: Elliott Tuttle, Anchorage, AK (US); James Fraser, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 105 days.

(21) Appl. No.: 16/855,539

(22) Filed: Apr. 22, 2020

(65) Prior Publication Data

US 2021/0332656 A1 Oct. 28, 2021

(51) Int. Cl.
*E21B 23/10* (2006.01)
*E21B 23/04* (2006.01)

(52) U.S. Cl.
CPC ..... *E21B 23/10* (2013.01); *E21B 23/04* (2013.01)

(58) Field of Classification Search
CPC ..... E21B 23/04; E21B 23/10; E21B 43/10
See application file for complete search history.

(56) References Cited

U.S. PATENT DOCUMENTS

| | | | | |
|---|---|---|---|---|
| 4,893,678 | A | 1/1990 | Stokley et al. | |
| 7,665,515 | B2 | 2/2010 | Mullins | |
| 2015/0136394 | A1* | 5/2015 | Turley | E21B 33/13 166/285 |
| 2016/0326819 | A1 | 11/2016 | Turley et al. | |

FOREIGN PATENT DOCUMENTS

| | | | |
|---|---|---|---|
| EP | 3309353 | A1 | 4/2018 |
| WO | 2019168981 | A1 | 9/2019 |

OTHER PUBLICATIONS

Notification of Transmittal of the International Search Report and the Written Opinion of the International Searching Authority; International Filing Date Mar. 23, 2021; dated Jul. 13, 2021; 9 pages.

* cited by examiner

*Primary Examiner* — Giovanna Wright
(74) *Attorney, Agent, or Firm* — Cantor Colburn LLP

(57) ABSTRACT

A running tool includes a tool body having a fluid conduit, and an actuation assembly including an actuator member connected to a release mechanism, the actuator member moveable in an axial direction from a first position to a second position to cause the release mechanism to disengage with a downhole component. The actuation assembly includes a first pressure chamber in pressure communication with the fluid conduit, where the running tool is configured to be activated to release the downhole component by applying fluid pressure to the first pressure chamber to generate an actuation force that moves the actuator member to the second position. The running tool also includes a second pressure chamber in pressure communication with the same fluid conduit. The second pressure chamber is configured to receive borehole fluid from the fluid conduit during deployment and apply a balancing force to the actuator member during the deployment.

20 Claims, 5 Drawing Sheets

PRESSURE BALANCED RUNNING TOOL

BACKGROUND

There are a variety of tools and components that are deployed downhole to facilitate production of hydrocarbons. Such components can include safety valves, inflow control valves, production screens and inflow control devices. In some cases, tools and components are deployed downhole using a running tool. For example, casing strings (e.g., liners) and completion strings can be deployed using coiled tubing in conjunction with a hydraulically activated running tool that is operated using borehole fluid pressure.

Some downhole operations, such as coiled tubing drilling operations, utilize high circulation pressures (e.g., greater than 5,000 psi). Running a liner or other component as part of such operations using a hydraulically activated running tool presents a risk of premature releasing of the liner, due to the high circulation pressures. Accordingly, it would be desirable to have a hydraulically activated running tool that can be effectively utilized at high circulating pressures.

SUMMARY

An embodiment of a running tool configured to deploy a downhole component includes a tool body having a fluid conduit, and an actuation assembly including an actuator member connected to a release mechanism, the actuator member moveable in an axial direction from a first position to a second position to cause the release mechanism to disengage with a downhole component. The actuation assembly includes a first pressure chamber in pressure communication with the fluid conduit, where the running tool is configured to be activated to release the downhole component by applying fluid pressure above a threshold value to the first pressure chamber to generate an actuation force that moves the actuator member to the second position. The running tool also includes a second pressure chamber in pressure communication with the same fluid conduit. The second pressure chamber is configured to receive borehole fluid from the fluid conduit during deployment and apply a balancing force to the actuator member during the deployment and prior to activating the running tool, the balancing force opposing the actuation force.

An embodiment of a method of deploying a downhole component in a borehole includes releasably connecting the downhole component to a running tool. The running tool includes a tool body having a fluid conduit and an actuation assembly including an actuator member connected to a release mechanism, the actuator member moveable in an axial direction from a first position to a second position to cause the release mechanism to disengage with a downhole component. The actuation assembly includes a first pressure chamber in pressure communication with the fluid conduit and configured to apply an axial force to the actuator member. The method also includes deploying the running tool and the downhole component into the borehole until the downhole component reaches a desired location, the deploying including applying a balancing force to the actuator member during the deployment and prior to activating the running tool by a second pressure chamber in pressure communication with the same fluid conduit, the balancing force opposing the axial force from the first pressure chamber. The method further includes activating the running tool to release the downhole component by applying fluid pressure above a threshold value to the first pressure chamber to generate an actuation force that moves the actuator member to the second position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Embodiments described herein include a hydraulically activated running tool configured for use in deploying downhole components in a borehole. The running tool includes a main pressure chamber in pressure communication with a borehole fluid conduit. The main pressure chamber is operably connected to an actuator piston connected to a release mechanism. Increasing pressure in the main pressure chamber to a selected pressure causes the pressure chamber to move the actuator piston and activate the release mechanism.

In one embodiment, the running tool includes a pressure balancing configuration that includes a second pressure chamber in pressure communication with the borehole fluid conduit. The second pressure chamber acts to oppose axial forces exerted by the main pressure chamber during run-in or otherwise before the running tool is activated. To activate the running tool, the second pressure chamber is isolated from the main pressure chamber and the main pressure chamber is pressurized to activate the release mechanism.

Embodiments described herein provide a number of advantages and technical effects. For example, embodiments of the pressure balancing mechanism act to balance forces on the actuator piston to prevent premature activation at high circulation pressures. Accordingly, the running tool can be used without the need to limit pump pressures or rates when deploying a liner or other component.

Figure 1:
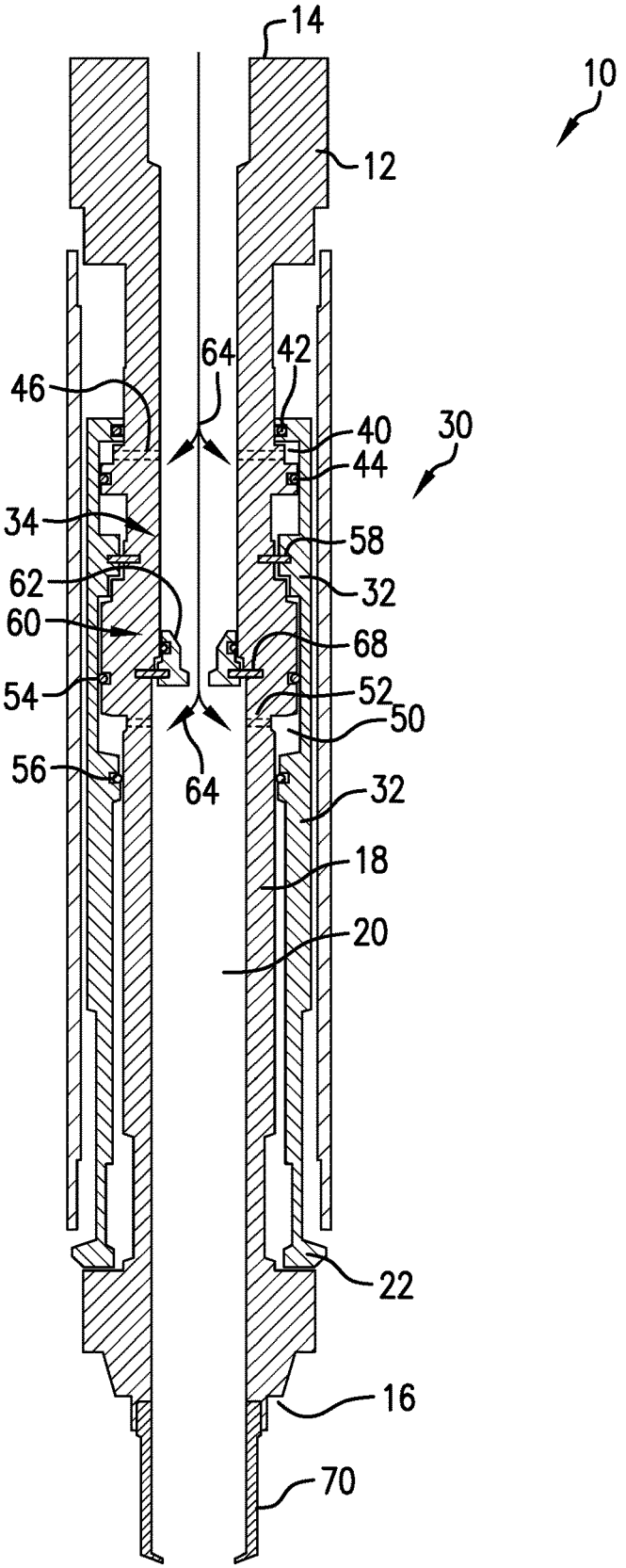
FIG. 1 depicts an embodiment of a hydraulically activated running tool that includes a pressure balancing configuration.
Figure 2:
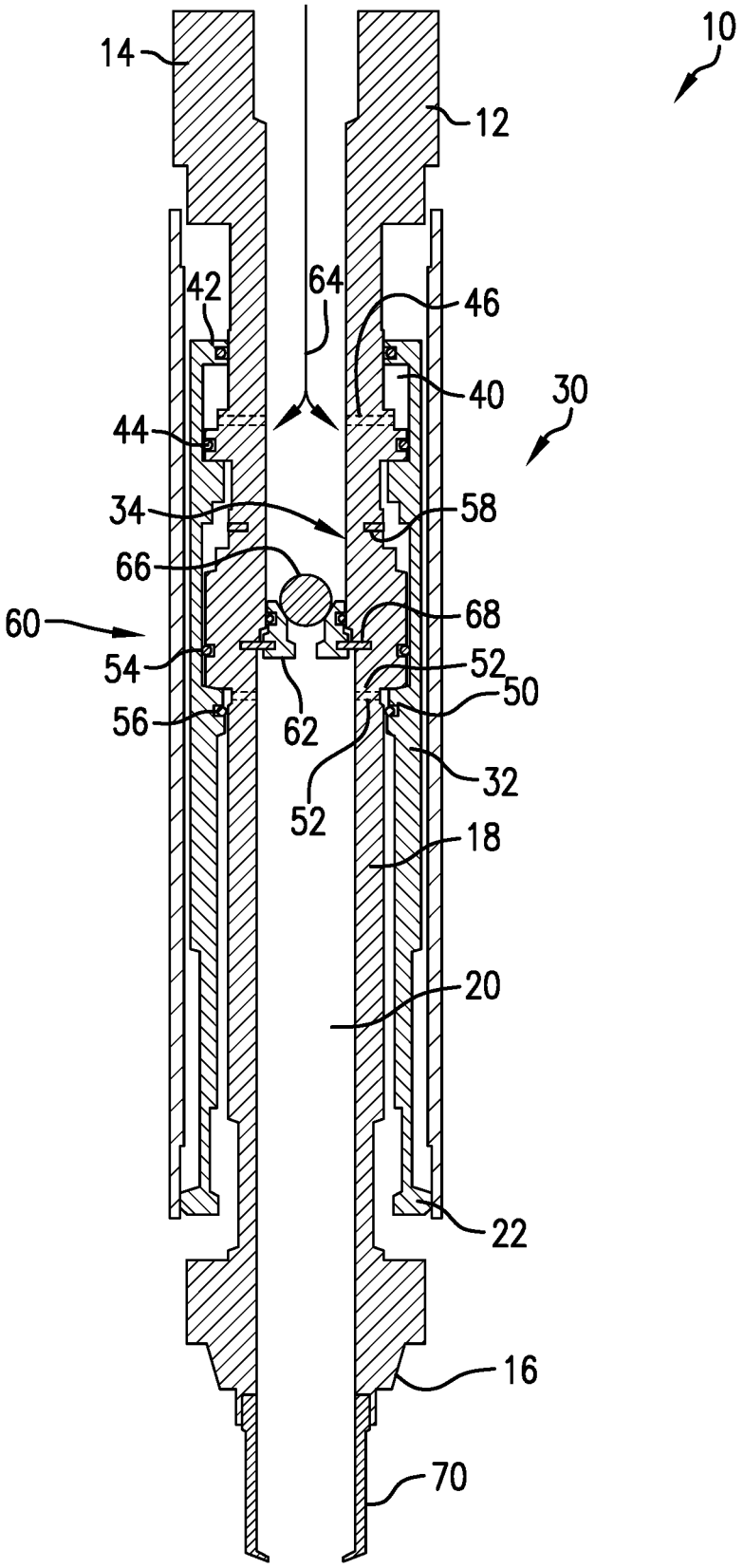
FIG. 2 depicts the running tool of FIG. 1 and illustrates activation of the running tool by isolating a section of a fluid conduit.
Figure 3:
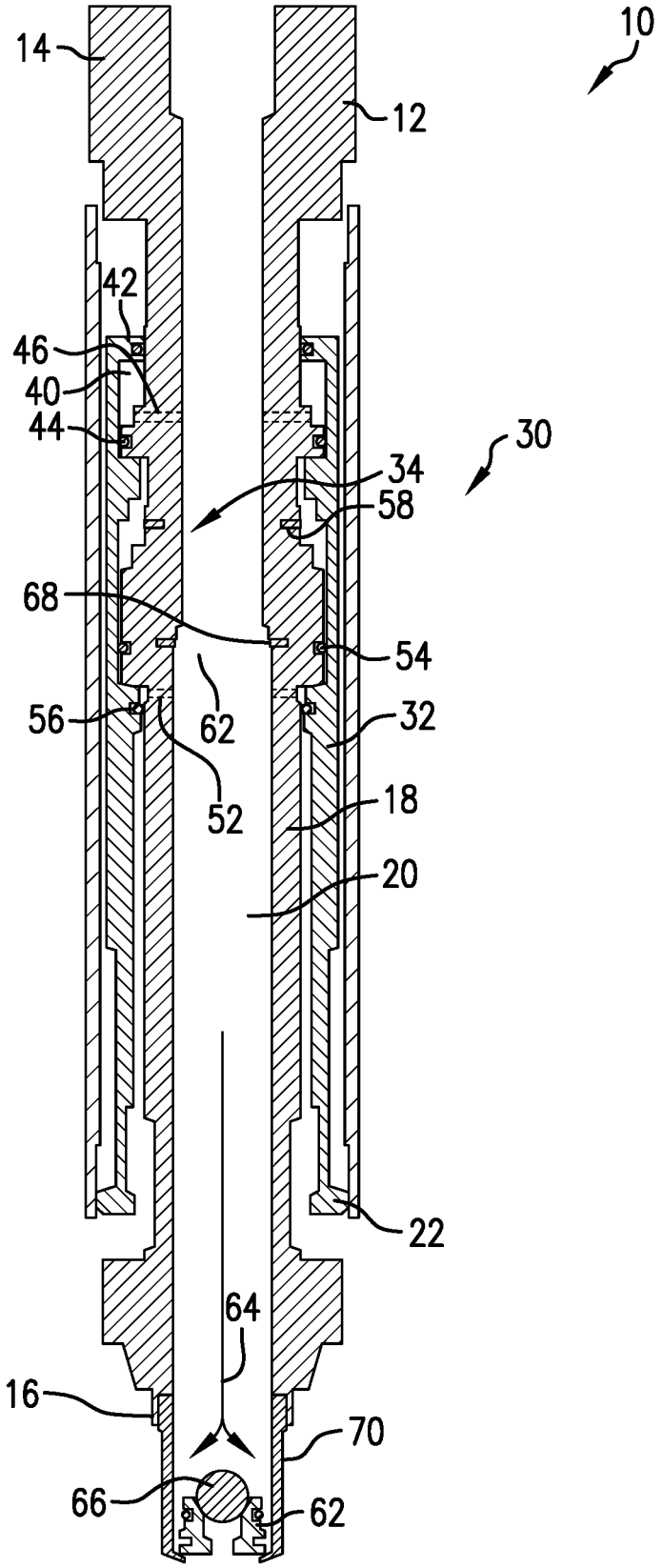
FIG. 3 depicts the running tool of FIGS. 1 and 2, and illustrates re-establishment of fluid flow through the running tool after activation.

FIGS. 1-3 illustrate an embodiment of a running tool 10. The running tool 10 is used to deploy various tools and/or components into a borehole, which may be a pilot borehole and/or a lateral borehole. The running tool 10 is configured to be releasably attached or connected to a downhole component, so that once the downhole component is disposed at a desired depth or location, the running tool 10 can be released and retracted to the surface.

The running tool 10 includes a tool body 12 having an upper end 14 and a lower end 16, one or more of which may be connected to components of a borehole string, such as a coiled tubing or other tubular running string. It is noted that "upper" and "lower" are terms used to indicate a relative position in a borehole as measured from the surface. In vertical boreholes, a lower component has a vertical depth that is greater than an upper component. However, in deviated and horizontal boreholes, an upper and lower component can have the same vertical depth, or the upper component can have a greater vertical depth than the lower component.

The tool body 12 includes a mandrel 18 that defines a central fluid conduit 20. The central fluid conduit 20 allows borehole fluid to be circulated through the running tool 10 to and from other downhole components. The running tool 10 also includes a release mechanism such as a collet 22, which is retracted or otherwise actuated to release a connected downhole component.

An actuation assembly 30 of the tool 10 includes an actuator having an elongated body connected to the collet 22 or other release mechanism. In one embodiment, the actuator is an actuator piston 32 configured as a cylindrical (or partially cylindrical) member. The actuator piston 32 extends axially and is connected to the collet in any suitable manner, such that axial movement of the actuator piston 32 moves the collet 22 to release the downhole component. The actuator piston 32 and the collet 22 may be integrated into a single body as shown in FIG. 1, or be attached or otherwise operably connected so that the collet 22 can be moved by moving the actuator piston.

In one embodiment, the actuator piston 32 is connected via a shear assembly 34 to the mandrel 18. When the shear assembly 34 is intact, the actuator piston 32 is maintained at a first axial position, and the collet 22 is in an axial position (a "run-in" position), in which the collet 22 is engaged with the downhole component.

In one embodiment, the running tool 10 is hydraulically activated. For example, the actuation assembly 30 includes a first pressure chamber 40, also referred to as a main pressure chamber 40. The main pressure chamber 40 is defined by the mandrel 18 and the actuator piston 32, and includes O-rings 42 and 44 or other sealing mechanisms.

The actuator piston 32 is moveable in an axial direction (i.e., a direction parallel or partially parallel to a longitudinal axis of the tool 10) relative to the mandrel 18, such that the pressure chamber 40 increases in volume as the actuator piston 32 slides upward relative to the mandrel 18. At least one fluid port 46 provides fluid communication with the central conduit 20, which in turn provides fluid communication with the surface.

To release a connected downhole component, a force is applied to the shear assembly 34 to allow axial movement of the actuator piston 32. The force may be applied by pressurizing fluid in the fluid conduit 20 (e.g., in conjunction with a ball seat assembly as discussed below), applying hydraulic pressure via a control line, or otherwise. Fluid pressure from the conduit 20 forces the actuator piston 32 upward, which correspondingly retracts the collet 22 and disengages the connected component.

The running tool 10 also includes a pressure balancing assembly or configuration that establishes a second pressure chamber 50 in the actuation assembly. The second pressure chamber 50 is in fluid and pressure communication with the fluid conduit 20 via, for example, at least one fluid port 52. The fluid port 52 can be selectively closed or blocked to allow for pressurization of the first pressure chamber 40 and actuation of the actuator piston 32.

The second pressure chamber 50 is defined, for example, by the mandrel 18 and the actuator piston 32, and O-rings 54 and 56 or other sealing mechanisms. Pressure in the second pressure chamber 50 exerts an axial force (a balancing force) that opposes the axial force applied by the main pressure chamber 40.

In one embodiment, the second pressure chamber 50 is exposed to fluid flowing through the fluid conduit 20, so that pressure is applied to both chambers 40 and 50 and thereby balances the chambers and balances the axial force on the actuator piston 32 and shear assembly 34. This allows for circulation of fluid during run-in with a circulating pressure that is higher than the running tool shear pressure (pressure required to shear the shear assembly 34).

In use, the second pressure chamber 50 balances axial forces on the actuator piston 32 as the running tool 50 and a connected component are deployed into a borehole. During deployment (e.g., run-in), fluid pressure through the running tool 10 is maintained at a selected circulation or run-in pressure. During the deployment, the fluid ports 46 and 52 allow fluid and pressure communication with both pressure chambers 40 and 50, effectively balancing the axial forces. Upon positioning the component at a selected location or depth, the second pressure chamber 50 is isolated from the first pressure chamber 40 and from fluid in the fluid conduit 20. The circulation pressure can then be increased to a shear pressure. At this pressure, the main pressure chamber 40 exerts an axial force that breaks the shear assembly 34 and forces the actuator member 32 to move and thereby retract the collet 22 and release the component.

Operation of the running tool is described below with reference to FIGS. 1-3. FIG. 1 shows the running tool 10 and the actuator piston 32 in a deployment or run-in position, in which the shear assembly 34 is intact and both pressure chambers are exposed to fluid in the fluid conduit 20. In this position, the collet 22 is in engagement with a connected downhole component.

In the embodiment of FIGS. 1-3, the shear assembly 34 includes a shear pin 58. Also in this embodiment, a fluid isolation assembly such as a ball seat assembly 60 is attached to the mandrel 18 and located axially between the pressure chambers 40 and 50. The ball seat assembly 60 includes a ball seat 62 that defines a restriction in the fluid conduit 20 on which a ball or other deployable object is seated to isolate the second pressure chamber 50 and permit pressurization to the shear pressure.

As shown in FIG. 1, in the run-in position, borehole fluid 64 applies pressure to both chambers to balance axial forces on the piston 32. Referring to FIG. 2, when the component is to be released, a ball 66 is landed on the ball seat 62 and fluid pressure is applied only to the main pressure chamber 40. Upon pressurization to the shear pressure, the shear pin 58 shears off and pressure in the main pressure chamber 40 forces the actuator piston 32 upwards and thereby retracts the collet 22. Movement of the actuator piston 32 increases the volume of the main pressure chamber 40 and reduces the volume of, or entirely eliminates, the second pressure chamber 50.

As shown in FIG. 3, after the component has been released, the ball 66 is moved past the ball seat 62 to reestablish fluid flow through the length of the running tool 10. In this embodiment, to move the ball 66, pressure above the ball is increased to a pressure sufficient to shear a ball seat shear pin 68 and detach the ball seat 62 from the mandrel 18. The ball 66 and the ball seat 62 are caught in a catcher 70 and flow is regained.

Figure 4:
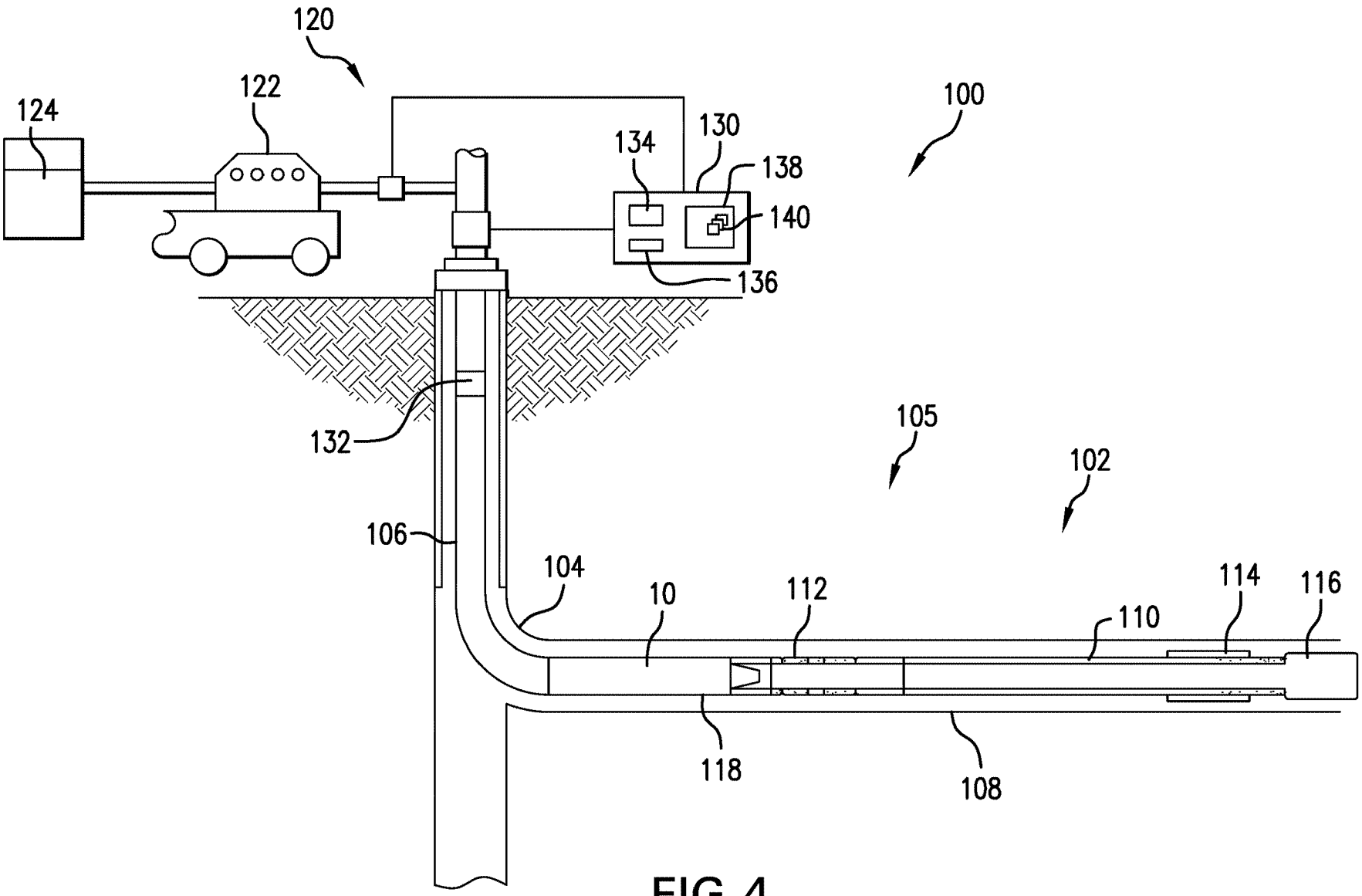
FIG. 4 illustrates an embodiment of a system for performing energy industry operations and depicts components used to deploy a downhole component.

FIG. 4 illustrates an embodiment of a system 100 for performing energy industry operations, such as a completion and hydrocarbon production system 10, and also illustrates an embodiment of a deployment system for running or deploying downhole components using the running tool 10.

The system 100 includes a liner assembly 102 that is deployed into a borehole 104 in an earth formation 105 using a running string 106. In one embodiment, the running string 106 is a coiled tubing (CT) string. The running string 106 is connected to the running tool 10, which is releasably attached to the liner assembly 102. The liner assembly 102, as shown in FIG. 4, can be deployed using the running string 106 and the running tool 10 into a lateral borehole 108 extending from the borehole 104.

The liner assembly 102 in this embodiment includes a liner (casing string) 110, which is typically deployed through a previous casing string and suspended via a liner hanger. The liner assembly 102 may include various components, such as a packer assembly 112, a landing collar 114 and a casing shoe 116. Other components may include sensing or measurement devices, fluid control devices, screens, sleeves, valves and/or any other desired components.

Various components may be configured to communicate with a surface location and/or a remote location, for example, via one or more conductors 118 (e.g., hydraulic lines, electrical conductors and/or optical fibers) and/or wireless telemetry (e.g., mud pulse, electromagnetic, etc.)

The liner assembly 102 and the running string 106 are shown as examples for illustration purposes and are not intended to be limiting. For example, the system 100 may include a variety of other components, such as a completion string or a production assembly. The running string 106 and/or other components may be deployed using any type of running string, such as a pipe string.

The system 100 also includes surface equipment 120 such as a drill rig, rotary table, top drive, blowout preventer and/or others to facilitate deploying the liner assembly, releasing the running tool 10 and/or controlling downhole components. For example, the surface equipment 120 includes a fluid control system 122 including one or more pumps in fluid communication with a fluid tank 124 or other fluid source.

In one embodiment, the system 10 includes a processing device such as a surface processing unit 130, and/or a subsurface processing unit 132 disposed in the borehole 104 and/or 108 and connected to one or more downhole components. The surface processing unit 130, in one embodiment, includes a processor 134, an input/output device 136 and a data storage device (or a computer-readable medium) 138 for storing data, files, models, data analysis modules and/or computer programs. The processing device may be configured to perform functions such as controlling downhole components, controlling deployment of downhole components, controlling fluid circulation, monitoring components during deployment, transmitting and receiving data, processing measurement data and/or monitoring operations. For example, the storage device 138 stores processing modules 140 for performing one or more of the above functions.

Figure 5:
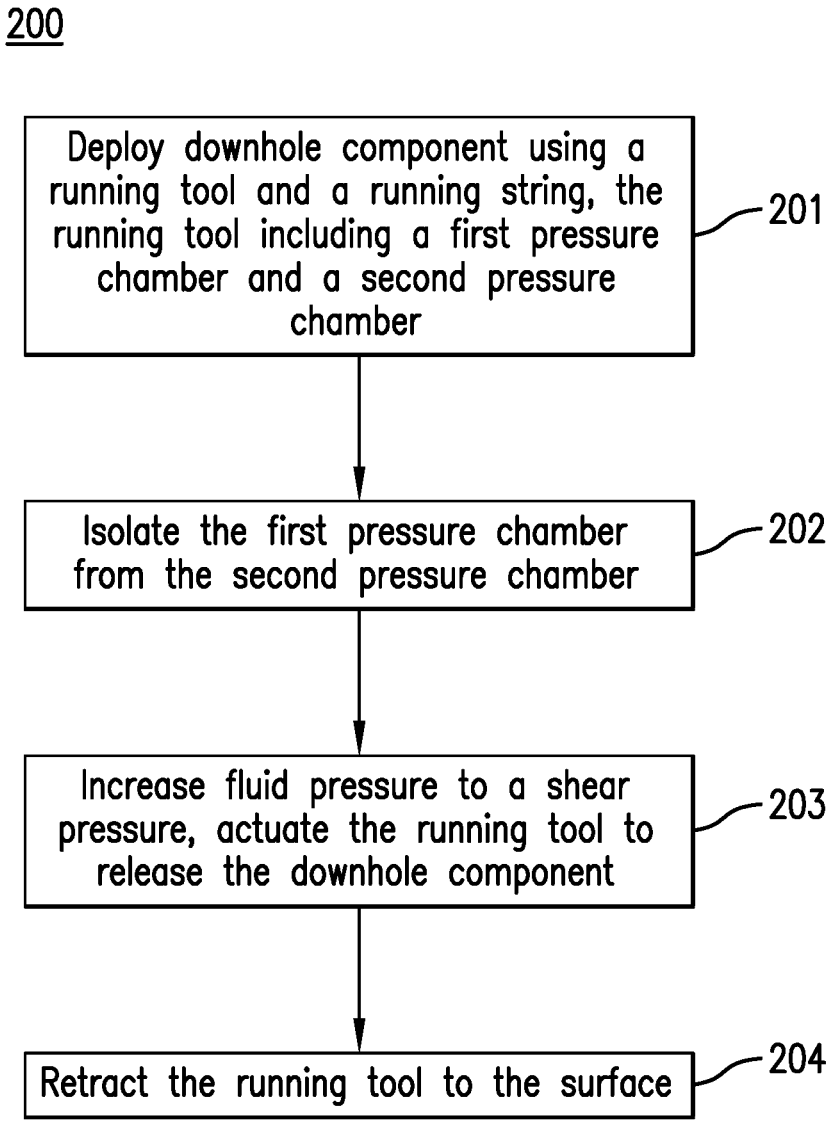
FIG. 5 is a flow chart depicting an embodiment of a method of deploying a downhole component.

FIG. 5 is a flow chart that illustrates an embodiment of a method 200 of deploying or running a downhole component into a borehole, and/or controlling aspects of an energy industry operation. Aspects of the method 200, or functions or operations performed in conjunction with the method, may be performed by one or more processing devices, such as the surface processing unit 130, either alone or in conjunction with a human operator.

The method 200 includes one or more stages 201-204. In one embodiment, the method 200 includes the execution of all of the stages 201-204 in the order described. However, certain stages may be omitted, stages may be added, or the order of the stages changed.

The method 200 is discussed in conjunction with the system 100 of FIG. 4 for illustrative purposes. It is noted that the method is not limited to the specific embodiment discussed below.

Although the method is discussed in conjunction with running a liner assembly, it is not so limited and can be used to deploy a variety of components and systems. Examples of such components and systems include, completions, lower completions (e.g., in two-trip operations), intelligent production systems and others.

In the first stage 201, a downhole component such as the liner assembly 102 deployed into a borehole (e.g., the lateral borehole 108) by connecting the running tool 10 to the liner assembly 102 and connecting the running tool 10 to a running string such as a coiled tubing running string 106. The running tool 10 and the liner assembly 102 are advanced through the borehole until the liner assembly 102 is located at a desired depth or location. Borehole fluid is circulated through the running string 106 and the running tool 10 at a selected circulating pressure (run-in pressure). Due to the balancing configuration including the main pressure chamber 40 and the second pressure chamber 50, the running tool 10 is unaffected by differential pressures from the fluid conduit 20 to the annulus of the liner assembly 102 until it is desired to release the running tool 10, so that circulation rates do not need to be limited when running the liner assembly 102.

In the second stage 202, when the liner assembly 102 reaches the desired location, the second pressure chamber 50 is isolated from the main pressure chamber 40 so that pressure in the main pressure chamber 40 can be increased. For example, a ball 66 is dropped into the running string 106 and pumped to the running tool 10, where it lands on the ball seat 62.

In the third stage 203, the running tool 10 is released by increasing the pressure in the fluid conduit 18 to a shear pressure, i.e., a pressure sufficient to cause the main pressure chamber 40 to exert an axial force sufficient to shear off the shear assembly 34 and cause the actuator piston 32 to move upward. This movement in turn causes the collet 22 to retract and release the running tool 10 from the liner assembly 102. In the third stage, 204, the running string 106 and the running tool 10 are retracted or tripped to the surface.

Set forth below are some embodiments of the foregoing disclosure:

Embodiment 1: A running tool configured to deploy a downhole component, the running tool comprising: a tool body having a fluid conduit; an actuation assembly including an actuator member connected to a release mechanism, the actuator member moveable in an axial direction from a first position to a second position to cause the release mechanism to disengage with a downhole component, the actuation assembly including a first pressure chamber in pressure communication with the fluid conduit, wherein the running tool is configured to be activated to release the downhole component by applying fluid pressure above a threshold value to the first pressure chamber to generate an actuation force that moves the actuator member to the second position; and a second pressure chamber in pressure communication with the same fluid conduit, the second pressure chamber configured to receive borehole fluid from the fluid conduit during deployment and apply a balancing force to the actuator member during the deployment and prior to activating the running tool, the balancing force opposing the actuation force.

Embodiment 2: The running tool of any prior embodiment, wherein the first pressure chamber and the second pressure chamber are defined by the tool body and the actuator member.

Embodiment 3: The running tool of any prior embodiment, wherein the first pressure chamber is connected to the fluid conduit by a first fluid port, and the second pressure chamber is connected to the fluid conduit by a second fluid port.

Embodiment 4: The running tool of any prior embodiment, further comprising a shear assembly, the shear assembly configured to be sheared to allow for axial movement of the actuator member, the first pressure chamber disposed at a first location on one side of the shear assembly, and the second pressure chamber disposed at a second location on an opposite side of the shear assembly.

Embodiment 5: The running tool of any prior embodiment, further comprising a fluid isolation assembly configured to be to be operated to isolate the first pressure chamber from the second pressure chamber.

Embodiment 6. The running tool of any prior embodiment, wherein the fluid isolation assembly is disposed at a location along the fluid conduit between the first pressure chamber and the second pressure chamber.

Embodiment 7: The running tool of any prior embodiment, wherein the fluid isolation assembly includes a ball seat.

Embodiment 8: The running tool of any prior embodiment, wherein the actuator member is configured to be moved to the second position by deploying a ball through a running string, landing the ball on the ball seat to isolate the first pressure chamber from the second pressure chamber, and applying the fluid pressure to borehole fluid upstream of the ball and the ball seat.

Embodiment 9: The running tool of any prior embodiment, wherein the downhole component includes a liner assembly.

Embodiment 10: The running tool of any prior embodiment, wherein the running tool is configured to be connected to a running string for deployment of the downhole component.

Embodiment 11: A method of deploying a downhole component in a borehole, the method comprising: releasably connecting the downhole component to a running tool, the running tool including a tool body having a fluid conduit and an actuation assembly including an actuator member connected to a release mechanism, the actuator member moveable in an axial direction from a first position to a second position to cause the release mechanism to disengage with a downhole component, the actuation assembly including a first pressure chamber in pressure communication with the fluid conduit and configured to apply an axial force to the actuator member; deploying the running tool and the downhole component into the borehole until the downhole component reaches a desired location, the deploying including applying a balancing force to the actuator member during the deployment and prior to activating the running tool by a second pressure chamber in pressure communication with the same fluid conduit, the balancing force opposing the axial force from the first pressure chamber; and activating the running tool to release the downhole component by applying fluid pressure above a threshold value to the first pressure chamber to generate an actuation force that moves the actuator member to the second position.

Embodiment 12: The method of any prior embodiment, wherein the first pressure chamber and the second pressure chamber are defined by the tool body and the actuator member.

Embodiment 13: The method of any prior embodiment, wherein the first pressure chamber is connected to the fluid conduit by a first fluid port, and the second pressure chamber is connected to the fluid conduit by a second fluid port.

Embodiment 14: The method of any prior embodiment, wherein activating the running tool includes isolating the first pressure chamber from the second pressure chamber, and applying a fluid pressure to the first pressure chamber to shear a shear assembly to allow for axial movement of the actuator member, the first pressure chamber disposed at a first location on one side of the shear assembly, and the second pressure chamber disposed at a second location on an opposite side of the shear assembly.

Embodiment 15: The method of any prior embodiment, further comprising a fluid isolation assembly configured to be to be operated to isolate the first pressure chamber from the second pressure chamber.

Embodiment 16: The method of any prior embodiment, wherein the fluid isolation assembly is disposed at a location along the fluid conduit between the first pressure chamber and the second pressure chamber.

Embodiment 17: The method of any prior embodiment, wherein the fluid isolation assembly includes a ball seat.

Embodiment 18: The method of any prior embodiment, wherein activating the running tool includes deploying a ball through a running string, landing the ball on the ball seat to isolate the first pressure chamber from the second pressure chamber, and applying the fluid pressure to borehole fluid upstream of the ball and the ball seat to move the actuator member to the second position.

Embodiment 19: The method of any prior embodiment, wherein the downhole component includes a liner assembly.

Embodiment 20: The method of any prior embodiment, wherein the running tool is configured to be connected to a running string for deployment of the downhole component.

In support of the teachings herein, various analysis components may be used, including a digital and/or an analog system. For example, embodiments such as the system 10, downhole tools, hosts and network devices described herein may include digital and/or analog systems. Embodiments may have components such as a processor, storage media, memory, input, output, wired communications link, user interfaces, software programs, signal processors (digital or analog), signal amplifiers, signal attenuators, signal converters and other such components (such as resistors, capacitors, inductors and others) to provide for operation and analyses of the apparatus and methods disclosed herein in any of several manners well-appreciated in the art. It is considered that these teachings may be implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A running tool configured to deploy a downhole component, the running tool comprising:

a tool body having a fluid conduit;

an actuation assembly including an actuator member connected to a release mechanism, the actuator member moveable in an axial direction from a first position to a second position to cause the release mechanism to disengage with a downhole component, the actuation assembly including a first pressure chamber in pressure communication with the fluid conduit, wherein the running tool is configured to be activated to release the downhole component by applying fluid pressure above a threshold value to the first pressure chamber to generate an actuation force that moves the actuator member to the second position; and a second pressure chamber in pressure communication with the same fluid conduit, the second pressure chamber configured to receive borehole fluid from the fluid conduit during deployment and apply a balancing force to the actuator member during the deployment and prior to activating the running tool, the balancing force opposing the actuation force.

2. The running tool of claim 1, wherein the first pressure chamber and the second pressure chamber are defined by the tool body and the actuator member.

3. The running tool of claim 2, wherein the first pressure chamber is connected to the fluid conduit by a first fluid port, and the second pressure chamber is connected to the fluid conduit by a second fluid port.

4. The running tool of claim 1, further comprising a shear assembly, the shear assembly configured to be sheared to allow for axial movement of the actuator member, the first pressure chamber disposed at a first location on one side of the shear assembly, and the second pressure chamber disposed at a second location on an opposite side of the shear assembly.

5. The running tool of claim 1, further comprising a fluid isolation assembly configured to be to be operated to isolate the first pressure chamber from the second pressure chamber.

6. The running tool of claim 5, wherein the fluid isolation assembly is disposed at a location along the fluid conduit between the first pressure chamber and the second pressure chamber.

7. The running tool of claim 6, wherein the fluid isolation assembly includes a ball seat.

8. The running tool of claim 7, wherein the actuator member is configured to be moved to the second position by deploying a ball through a running string, landing the ball on the ball seat to isolate the first pressure chamber from the second pressure chamber, and applying the fluid pressure to borehole fluid upstream of the ball and the ball seat.

9. The running tool of claim 1, wherein the downhole component includes a liner assembly.

10. The running tool of claim 1, wherein the running tool is configured to be connected to a running string for deployment of the downhole component.

11. A method of deploying a downhole component in a borehole, the method comprising:

releasably connecting the downhole component to a running tool, the running tool including a tool body having a fluid conduit and an actuation assembly including an actuator member connected to a release mechanism, the actuator member moveable in an axial direction from a first position to a second position to cause the release mechanism to disengage with a downhole component, the actuation assembly including a first pressure chamber in pressure communication with the fluid conduit and configured to apply an axial force to the actuator member;

deploying the running tool and the downhole component into the borehole until the downhole component reaches a desired location, the deploying including applying a balancing force to the actuator member during the deployment and prior to activating the running tool by a second pressure chamber in pressure communication with the same fluid conduit, the balancing force opposing the axial force from the first pressure chamber; and activating the running tool to release the downhole component by applying fluid pressure above a threshold value to the first pressure chamber to generate an actuation force that moves the actuator member to the second position.

12. The method of claim 11, wherein the first pressure chamber and the second pressure chamber are defined by the tool body and the actuator member.

13. The method of claim 12, wherein the first pressure chamber is connected to the fluid conduit by a first fluid port, and the second pressure chamber is connected to the fluid conduit by a second fluid port.

14. The method of claim 11, wherein activating the running tool includes isolating the first pressure chamber from the second pressure chamber, and applying a fluid pressure to the first pressure chamber to shear a shear assembly to allow for axial movement of the actuator member, the first pressure chamber disposed at a first location on one side of the shear assembly, and the second pressure chamber disposed at a second location on an opposite side of the shear assembly.

15. The method of claim 11, further comprising a fluid isolation assembly configured to be to be operated to isolate the first pressure chamber from the second pressure chamber.

16. The method of claim 15, wherein the fluid isolation assembly is disposed at a location along the fluid conduit between the first pressure chamber and the second pressure chamber.

17. The method of claim 16, wherein the fluid isolation assembly includes a ball seat.

18. The method of claim 17, wherein activating the running tool includes deploying a ball through a running string, landing the ball on the ball seat to isolate the first pressure chamber from the second pressure chamber, and applying the fluid pressure to borehole fluid upstream of the ball and the ball seat to move the actuator member to the second position.

19. The method of claim 11, wherein the downhole component includes a liner assembly.

20. The method of claim 11, wherein the running tool is configured to be connected to a running string for deployment of the downhole component.

* * * * *